United States Patent [19]

Kukes et al.

[11] Patent Number: 4,465,589

[45] Date of Patent: Aug. 14, 1984

[54] REMOVAL OF CONTAMINANTS FROM ORGANIC COMPOSITIONS

[75] Inventors: Semyon J. Kukes; Jesse R. Harris, both of Bartlesville, Okla.

[73] Assignee: Phillips Petroleum Company, Bartlesville, Okla.

[21] Appl. No.: 457,340

[22] Filed: Jan. 12, 1983

[51] Int. Cl.[3] ..... C10G 29/28; C10G 17/08; C10G 21/02

[52] U.S. Cl. ..... 208/208 R; 208/221; 208/222; 208/238; 208/251 R; 208/252; 208/254 R

[58] Field of Search ..... 208/208, 251 R, 254 R, 208/292, 238, 240, 291, 221, 222, 252

[56] References Cited

U.S. PATENT DOCUMENTS

| | | | |
|---|---|---|---|
| 2,846,358 | 8/1958 | Bieber et al. | 208/251 R |
| 2,906,693 | 9/1959 | Donaldson | 208/87 |
| 3,016,349 | 1/1962 | Oswald et al. | 208/254 R |
| 3,159,571 | 12/1964 | Reman et al. | 208/251 R |
| 3,309,309 | 3/1967 | Hess | 208/254 R |
| 3,481,865 | 12/1969 | Samuels | 208/251 R |
| 3,511,774 | 5/1970 | Long et al. | 208/251 R |
| 3,661,771 | 5/1972 | Havens | 208/240 |
| 4,191,639 | 3/1980 | Audeh et al. | 208/309 |
| 4,332,676 | 6/1982 | Baset | 208/254 R |

*Primary Examiner*—Delbert E. Gantz
*Assistant Examiner*—O. Chaudhuri

[57] ABSTRACT

Metals, nitrogen and/or sulfur, particularly vanadium, nickel and nitrogen, are removed from organic compositions, particularly heavy hydrocarbon oils, by contacting the organic composition with a methylating agent, preferably dimethyl sulfate, under conditions sufficient to form a precipitate, including the contaminants, and separating the precipitate from the organic composition as by filtration, decantation, and the like. In another embodiment of the present invention, the treatment with the methylating agent is carried out in conjunction with treatment with an acid gas and water or a solvent, such as a combination of carbon dioxide and water.

11 Claims, No Drawings

REMOVAL OF CONTAMINANTS FROM ORGANIC COMPOSITIONS

BACKGROUND OF THE INVENTION

The present invention relates to the removal of metal, nitrogen and sulfur contaminants from organic compositions. More specifically, the present invention relates to the removal of metal, nitrogen, and sulfur contaminants from organic compositions by the use of methylating agents.

It is known that many organic compositions, particularly hydrocarbons such as crude oil, contain at least small amounts of a contaminating metals, sulfur and nitrogen which are detrimental, particularly in the processing of such materials to produce commercially valuable products. In the recent past, light crude oils have been available in sufficient quantities to permit their use almost exclusively for the production of commercially valuable products such as gasoline, fuel oils, and feedstocks for petrochemical production. Such oils contain very small amounts of metallic contaminants and nitrogen. Therefore, the only contaminant of any significance was sulfur. However, the sulfur is present in such oils in relatively small amounts and in a form which can be readily removed by techniques such as hydrogenation. The current shortage of light, sweet crude oils has substantially increased the necessity of utilizing heavier crude oils as well as oils produced from coal and lignite, tar sands, shale and the like and will undoubtedly increase rapidly in the future. By contrast to light crude oils, such heavy oils and synthetic oils contain substantially larger amounts of sulfur and more complex in difficult to remove forms, substantial amounts of nitrogen compounds also in a difficult to remove form as well as significant amounts of metals, such as vanadium and nickel. The sulfur and nitrogen not only form acidic compounds which are detrimental in further processing but produce significant amounts of air pollutants when the products are burned as fuels. The presence of metals also makes further processing difficult since the metals generally act as poisons for catalysts employed in processes such as catalytic cracking, hydrogenation, hydrodesulfurization, etc. At the present time, the most prevalent technique for the removal of sulfur and nitrogen is hydrogenation. However, the removal of sulfur requires substantially larger amounts of hydrogen and more severe conditions than previously utilized and the removal of nitrogen requires still higher volumes of hydrogen and more severe conditions. The necessity of utilizing substantial amounts of hydrogen also creates a problem not heretofore encountered. In most refinery operations, a catalytic reforming unit exists which has a net production of hydrogen. In the past, the hydrogen produced by a catalytic reforming unit has been sufficient to supply all of the hydrogen needs of the refinery. However, where the heavier feed materials, which are highly contaminated, are to be processed this is no longer the case and additional hydrogen must be produed by other means such as methane reforming, etc. In the past, there has been no particularly effective and economical means of removing metallic contaminants from the crude oils, etc. Instead, the problems created by the presence of such metals have been essentially neutralized during catalytic treating operations such as hydrocracking by techniques such as metal passivation. In any event, the seriousness of the above mentioned problems requries that some technique be available for the removal of such contaminants and the removal of even small amounts prior to or during processing would be highly advantageous.

SUMMARY OF THE INVENTION

It is therefore an object of the present invention to provide an improved process for treating organic compositions which overcomes the above and other problems of the prior art. Another object of the present invention is to provide an improved process for treating organic compositions which improves subsequent processability thereof. Yet another object of the present invention is to provide an improved technique for treating organic compositions which reduces pollution resulting from the burning of fuels derived from such organic compositions. Another and further object of the present invention is to provide an improved technique for the removal of metal, nitrogen and/or sulfur contaminants from organic compositions. A still further object of the present invention is to provide an improved technique for the removal of metal, nitrogen and/or sulfur contaminants from crude oils and synthetic oils. A further object of the present invention is to provide an improved technique for the removal of metal, nitrogen and/or sulfur contaminants from organic compositions which is relatively inexpensive. Another object of the present invention is to provide an improved technique for the removal of metal, nitrogen and/or sulfur contaminants from organic compositions which is relatively simple to operate. Another object of the present invention is to provide an improved process for the removal of metal, nitrogen and/or sulfur contaminants from organic compositions in conjunction with other solvents and/or extractants. A further object of the present invention is to provide an improved technique for the removal of metal, nitrogen and/or sulfur contaminants from organic compositions which results in synergistic action in conjunction with other solvents and extractants. These and other objects of the present invention will be apparent from the following description of the invention.

In accordance with the present invention, it has been found that organic compositions and particularly crude oils and synthetic oils can be treated in a simple and economic manner to improve the processability thereof and reduce the production of pollutants in the burning of the fuels derived therefrom by contacting the organic composition with a methylating agent, for example, dimethyl sulfate to form a precipitate, including the contaminants, and separating the precipitate from the organic composition.

In another aspect of the present invention, it has been found that the above mentioned methylating agents act synergistically in conjunction with diluents and/or solvents such as toluene and/or other extractants such as acidic gases, for example, carbon dioxide.

DESCRIPTION OF THE PREFERRED EMBODIMENTS

In accordance with the present invention, organic compositions are treated with a methylating agent which precipitates metal contaminants particularly nickel and vanadium, nitrogen contaminants and also some sulfur compounds and the precipitate is thereafter separated from the other compositon.

Organic compositions which can be effectively treated in accordance with the present invention include crude oils, particularly heavy crude oils, products from the extraction and/or liquefaction of coal and lignite, products from the extraction of tar sands, products from the extraction and/or liquefaction of shale and similar synthetic oils.

It is known that anywhere from 40 to 70 percent of metals, such as nickel and vanadium and other contaminants, are present in crude oils any synthetic oils in the form of porphyrins. While it is not intended that the present invention be restricted to any particular theory, it is believed that the methylating agents combine with metalloporphyrins, asphaltenes and/or other complex structures containing metal, nitrogen and/or sulfur contaminants to form a precipitate or at the least a distinct separable phase which can then be removed from the treated oil. Such combination is also believed to be the result of the methylating agent being a strong electron acceptor and, in particular, having a higher electronegativity than the material to be removed. Accordingly, when the term "methylating agent or agents" is utilized in the present application, this term is meant to include a substance including a strong electron acceptor group or more specifically a substance having an electronegativity higher than the electronegativity of the contaminant material to be removed, for example, above about 2.0, and still more specifically, one having a methoxy group for example, dimethyl sulfate.

In light of the above, methylating agents useful in accordance with the present invention include $(CH_3O)_2SO_2$; $(CH_3O)_2SO$; $(CH_3O)SO_2X$; $CH_3X$; and the like and mixtures thereof, wherein X is a strong electron acceptor, such as a halogen, for example $Cl_2$; $O_2S(OCH_3)$; $OSO_3F$; and the like. Of the above mentioned materials $(CH_3O)_2SO_2$ has been found to be particularly effective. This material also is advantageous to the extent that it is relatively inexpensive.

Treating in accordance with the present invention may be carried out in any convenient manner either batchwise or continuously. Preferably, refluxing is employed. Likewise, treatment can be carried out in any known type of reactor such as a cascade, tray, scrubber or countercurrent reactor.

Suitable amounts of methylating agent will depend upon the nature and content of contaminants in the organic material, the nature of the organic material, etc. However, the amounts of methylating agent may range from about 0.01 to about 50 percent by weight based on the weight of the organic material being treated, preferably between about 0.05 and 10 percent by weight of the organic material being treated.

Temperatures of treatment can be anywhere from atmospheric to about 550° C. or higher, preferably between about 150° and about 550° C. and still more preferably between about 300° and 450° C.

Pressures may also range from atmospheric to about 5,000 psig, preferably between about 100 to 2,500 psig.

Contact times may also vary quite widely again depending upon the nature and content of the contaminants and the organic material being treated. However, a suitable range would be between about 0.01 and about 100 hours, preferably between about 0.1 and 10 hours.

Where the organic material to be treated is a highly viscous material, it is preferably diluted with a known diluent in order to reduce the viscosity. Such diluents include aromatic hydrocarbons, such as toluene, aliphatic hydrocarbons, such as hexane, heptane and the like and similar diluents. It has been found in accordance with the present invention that further improvement can be obtained when the methylating agent is utilized in conjunction with the use of a diluent or solvent and it appears in accordance with the tests of the present invention, that some synergistic action occurs. Diluents and solvents may be utilized in any suitable amount but preferably they are utilized in a ratio of about 0.5 volume per volume of organic material being treated to 5:1 or higher, preferably however, ratios of 1:1 to 5:1 are preferred. The diluent or solvent ratio will, of course, depend upon the nature of the organic material and the nature of the diluent or solvent.

While the present invention is quite effective when utilizing the methylating agent of the present invention in conjunction with diluents or solvents under subcritical conditions, the treatment can also be carried out where the diluent or solvent is under supercritical conditions. Suitable solvents and conditions of operations for such supercritical treatment are generally the same as those utilized in the supercritical extraction of shales and tar sands. Consequently, such solvents and conditions of operation may be the same as those set forth in U.S. Pat. No. 4,108,760, which is incorporated herein by reference.

In accordance with another embodiment of the present invention, it has been found that use of the methylating agents of the present invention in conjunction with an acidic gas can also be utilized. Tests of the present invention indicate that a synergistic effect is thus obtained. Suitable acidic gases for such purpose include carbon dioxide, hydrogen sulfide, sulfur dioxide, sulfur trioxide, hyrogen cyanide, etc. Carbon dioxide is preferred. Preferably, the acidic gas is utilized in the presence of an immiscible phase, particularly water. For such purposes, the ratio of organic material to water should be from about 0.01 to 5 volumes of organic material per volume of water and preferably between about 0.2 in 2 volumes of organic material per volume of water. The partial pressure of the acid gas can be from about 1 to 100 atmospheres or higher. The remaining operating conditions to be utilized in accordance with this particular embodiment are the same as those previously set forth. This embodiment can also be carried out under supercritical conditions.

The following examples illustrate typical results which were obtained in a laboratory evaluation of the present invention.

In a first series of runs, a Monogas pipeline oil, which contains significant amounts of nickel and vanadium was tested. This crude is a heavy Venezuelan crude which is diluted with a few percent of No. 6 oil to reduce its viscosity so that it can be pumped and transported by pipeline.

It was found in initial attempts to treat this crude, that the crude became more viscous on heating and separation of a precipitate from the crude was difficult. Accordingly, for the tests, 100 cc of crude were mixed with 100 cc of toluene. A 200 cc sample was heated to 112° C. and stirred with refluxing for 3 hours. Analysis of the resultant sample indicated a nickel content of 42.6 ppm and a vanadium content of 519 ppm. Another 200 cc sample of this mixture was then treated in the same manner except that 1.5 cc (1.5 percent by volume based on the volume of crude) of $(CH_3O)_2SO_2$ was added. Analysis of the thus treated sample resulted in 27.4 ppm of nickel and 392 ppm of vanadium. Thus, treatment in accordance with the present invention reduced the nickel content by about 40 percent and the vanadium content by about 25 percent.

Another series of runs was carried out in order to determine the ability of the $(CH_3O)_2SO_2$ to remove nitrogen from crudes containing significant amounts of chemically bound nitrogen. In a first test, an atmospheric gas oil containing about 800 ppm of nitrogen was tested. In this test, 150 cc of the oil was boiled for two hours. Analysis indicated that the remaining nitrogen amounted to 722 ppm. A second test was run in which 5 cc (3 percent by volume) of dimethyl sulfate was added to 150 cc of oil and boiled for 3 hours. Analysis of the product indicated a residual nitrogen content of 111 ppm.

In another test, 100 cc of the previously mentioned Monogas crude was stirred for 3 hours at 150° C. The sample was diluted for purposes of analysis with toluene. Analysis indicated a nitrogen content of 1,220 ppm. One hundred cc of the same crude was then mixed with 5 cc (5 percent by volume) of $(CH_3O)_2SO_2$ and again stirred for 3 hours at 150° C. The sample was diluted for analysis and a residual nitrogen content of 694 ppm was obtained.

Yet another sample of Monogas crude (150 cc) was diluted with 100 cc of toluene. The mixture was stirred with reflux at a temperature of 116° C. for 3 hours. Analysis indicated a nitrogen content of 2,520 ppm. One hundred sixty cc of the Monogas crude and toluene mixture was then mixed with 10 cc (8 percent by volume based on the crude oil) of $(CH_3O)_2SO_2$ and again stirred for 3 hours at 116° C. Subsequent analysis indicated a nitrogen content of 1,180 ppm.

Another test was then run to determine the effect of time on the dimethyl sulfate treatment and the removal of vanadium. In this test, dimethyl sulfate was mixed with Monogas crude and hexane in volume ratios of 1/40/80 and the mixture refluxed for the time set forth in the table below. Table I also indicates the percent removal of vanadium.

TABLE I

| Time of Reflux | % Removal of V |
|---|---|
| 0.5 hour | 29.3 |
| 1.0 hour | 39.3 |
| 1.5 hour | 40.2 |
| 2.0 hour | 42.5 |
| 3.0 hour | 40.7 |
| 6.0 hour | 45.0 |

The same mixture was also tested to determine the percent removal of nitrogen. The results of this test are set forth in Table II below.

TABLE II

| Time of Reflux | % Removal of N |
|---|---|
| 0.5 hour | 26.6 |
| 1.0 hour | 34.3 |
| 1.5 hour | 43.6 |
| 2.0 hour | 32.1 |
| 3.0 hour | 33.4 |

In yet another series of tests, dimethyl sulfate was mixed with Monogas crude and heptane in a volume ratio of 1/100/500 and again refluxed for the periods of time indicated in Table III below. Table III sets forth the percent removal of nitrogen under these conditions.

TABLE III

| Time of Reflux | % Removal of N |
|---|---|
| 0.5 hour | 22.3 |

TABLE III-continued

| Time of Reflux | % Removal of N |
|---|---|
| 1.0 hour | 23.1 |
| 1.5 hour | 25.2 |
| 2.0 hour | 26.2 |
| 3.0 hour | 33.2 |

In another series of tests, 450 cc of the Monogas crude was mixed with 150 cc of toluene. Table IV below sets forth the initial content of nickel and vanadium in parts per million of the oil toluene mixture. Twenty cc of dimethyl sulfate was then added to 600 cc of the mixture and refluxed for 40 minutes. Table IV sets forth the metal content after the subject treatment and the percent removal of metals. Table IV also sets forth the weight percent of oil recovered, the weight percent precipitate and percent yield of oil. A second series of tests was carried out in the same manner and the results of this second series are set forth in Table IV below.

TABLE IV

| | Initial | Treated | % Removal | |
|---|---|---|---|---|
| (1) Ni, ppm | 67 | 47 | 30 | |
| V, ppm | 306 | 204 | 33 | |
| Weight Oil, g. | | | | 428.5 |
| Weight Precipitate, g. | | | | 15.3 |
| Oil % Recovered | | | | 96.0 |
| (2) Ni, ppm | 72 | 46 | 36 | |
| V, ppm | 278 | 191 | 31 | |
| Weight Oil, g. | | | | 428.5 |
| Weight Precipitate, g. | | | | 12.1 |
| Oil % Recovered | | | | 97.0 |

In yet another series of tests, the above mentioned Monogas crude was diluted with an equal volume of toluene. Approximately 30 ml portions of the mixture were placed in a high pressure (Jerguson) cell. Water was pumped into the cell and the cell was pressurized with carbon dioxide to a pressure of 900 psig. The water was circulated through the cell with a pump drawing water from the lower aqueous layer and reintroducing it into the gas phase above the oil so as to cause the water to pass dropwise through the oil. The percent removal of nitrogen, nickel and vanadium are set forth in Table V below. Samples of the same mixture were also treated separately with dimethyl sulfate and dimethyl sulfite, respectively, as set forth in the table. Finally, samples of $CO_2/H_2O$ treated oil were then treated with dimethyl sulfate and dimethyl sulfite, respectively, under the conditions set forth in the table with the results of this combination treatment set forth.

TABLE V

| Treatment | % Ni Removal | % V Removal | % N Removal |
|---|---|---|---|
| $CO_2$ (900 psi)/$H_2O$ only | 5 | 4 | 6 |
| $(CH_3O)_2SO_2$ (1.23%, 1 hr reflux only | 33 | 34 | 44 |
| $(CH_3O)_2SO_2$ (1.23%, 1 hr reflux) + $CO_2/H_2O$ | 60 | 55 | 59 |
| $CO_2$ (900 psi)/$H_2O$ only | 5 | 4 | 6 |
| $(CH_3O)_2SO_2$ (2.44%, 1.5 h reflux) only | 45 | 60 | 48 |
| $(CH_3O)_2SO_2$ (2.44%, 1.5 h reflux) + $CO_2/H_2O$ | 66 | 70 | 64 |
| $CO_2$ (900 psi)/$H_2O$ only | 5 | 4 | 6 |
| $(CH_3O)_2SO$ (5% & 3 h reflux) only | 1 | 6 | 0 |
| $(CH_3O)_2SO$ (3.85%, 2 h reflux) | 22 | 23 | 30 |

TABLE V-continued

| Treatment | % Ni Removal | % V Removal | % N Removal |
|---|---|---|---|
| + $CO_2/H_2O$ | | | |

It is to be observed from the above that the combination treatment results in significantly improved metal and nitrogen removal as compared with the individual treatments. In addition, it appears that a synergistic effect results from the combination treatment as compared with the sum of the individual treatments. It is believed that the combination treatment can be carried out simultaneously or in any sequence, i.e., methylation before or after the treatment with the combination of carbon dioxide and water.

It should also be understood in connection with the present invention that the novel methylation of the present invention can also be carried out in combination with other conventional treating or reaction steps normally applied to the treatment of organic materials, particularly in conjunction with or simultaneously with the hydrogenation of the oil.

While specific modes of operation, materials, amounts of components and the like have been set forth herein, it is to be understood that such specific recitals are for purposes of illustration and setting forth the best mode of operation in accordance with the present invention and are not to be considered limiting.

We claim:

1. A method of removing at least one of metal, nitrogen and sulfur contaminants from an organic composition comprising:

(a) contacting said organic composition with a methylating agent under conditions sufficient to form a precipitate, including said contaminants;

(b) contacting said organic composition with an acid gas in the presence of one of water and a solvent under conditions sufficient to form a distinct phase separable from said organic composition; and (c) separating said precipitate and said distinct phase from said organic composition.

2. A method in accordance with claim 1 wherein steps (a) and (b) are carried out simultaneously.

3. A method in accordance with claim 1 wherein step (a) is carried out before step (b).

4. A method in accordance with claim 1 wherein step (b) is carried out before step (a).

5. A method in accordance with claim 1 wherein the methylating agent is dimethyl sulfate.

6. A method in accordance with claim 1 wherein the methylating agent is dimethyl sulfite.

7. A method in accordance with claim 1 wherein the acid gas is carbon dioxide in the presence of water.

8. A method in accordance with claim 1 wherein the organic composition is a hydrocarbon oil.

9. A method in accordance with claim 1 wherein the organic composition is a viscous hydrocarbon oil and a diluent is added thereto in an amount sufficient to reduce the viscosity of said hydrocarbon oil.

10. A method in accordance with claim 1 wherein the organic composition contains vanadium and nickel contaminants and said vanadium and nickel contaminants are removed.

11. A method in accordance with claim 1 wherein the organic composition contains nitrogen contaminants and said nitrogen contaminants are removed.

* * * * *